United States Patent [19]

Gurecki et al.

[11] 4,397,141

[45] Aug. 9, 1983

[54] METHOD AND APPARATUS FOR MAKING BALANCED METALLIC STRAND

[75] Inventors: William A. Gurecki; Lester A. Bartell, both of Rome, N.Y.

[73] Assignee: National-Standard Company, Niles, Mich.

[21] Appl. No.: 254,303

[22] Filed: Apr. 15, 1981

[51] Int. Cl.[3] ..... D07B 1/06; D07B 3/00; D07B 3/12

[52] U.S. Cl. ..... 57/58.59; 57/13; 57/58.52; 57/58.57; 57/58.7

[58] Field of Search ..... 57/3, 6, 9, 12, 13, 57/311, 58.3, 58.36, 58.38, 58.49, 58.59, 58.63, 58.65, 58.7, 66, 66.5, 332, 335, 351, 58.57

[56] References Cited

U.S. PATENT DOCUMENTS

| | | | |
|---|---|---|---|
| 2,143,203 | 1/1939 | Maxham | 57/58.59 |
| 4,087,956 | 5/1978 | Gre | 57/58.7 X |
| 4,328,662 | 5/1982 | Bretegnier et al. | 57/58.52 X |
| 4,332,131 | 1/1982 | Palsky et al. | 57/13 X |

*Primary Examiner*—Donald Watkins

*Attorney, Agent, or Firm*—Emrich, Lee, Brown & Hill

[57] ABSTRACT

A balanced finished strand is assembled from a plurality of filaments by first grouping the filaments each with its correct length using a twisting flyer, next setting the grouped filaments using an over twisting flyer, and finally taking up, post forming, and spooling the balanced finished strand using a double twist buncher mechanism. The over twisting flyer is positioned outside the double twist buncher mechanism and adjacent the twisting flyer.

7 Claims, 2 Drawing Figures

METHOD AND APPARATUS FOR MAKING BALANCED METALLIC STRAND

BACKGROUND OF THE INVENTION

Double twist bunchers have been used in the past to manufacture strand economically because each revolution of the loop revolving mechanism imparts two twists to a group of filaments. The double twister includes stationary let-off spools inside a revolving loop of the grouped filaments. A double twist buncher includes a strand take-up spool inside the revolving loop of the grouped filaments. Double twist bunchers are useful in the construction of the strand because more or less filament let-off spools can be used in association with the double twist bunchers. The number of filament let-off spools in a double twister is limited to the number provided inside the revolving loop when the twister is designed. Importantly, over twist flyers have been used in association with the manufacture of strand so that when the strand is cut, the strand will not fly apart thereby resulting in considerable down time for the stranding apparatus. For example, U.S. Pat. No. 4,087,956 describes an apparatus for making a strand wherein an over twist flyer is built into the stationary cradle of the double twist buncher. However, such an apparatus does not produce a balanced strand because the positioning of post-forming means between the twisting flyers results in lack of control over the tension of the strand during the assembly process. Moreover, the apparatus results in a structure wherein considerable distance exists between the twisting flyer and the over twist flyer, a structure which prevents control of the strand during assembly and precludes obtaining a balanced strand.

SUMMARY OF THE INVENTION

One object of the present invention is to provide a balanced finished strand utilizing a double twist buncher as one of the components of the strand assembly device.

Another object of the present invention is to provide a method of making a balanced metallic strand by grouping a plurality of filaments, each having a correct length by using a twisting flyer, setting the group filaments by using an over twist flyer, revolving the set of grouped filaments around a stationary cradle of a double twist buncher mechanism and taking up and spooling the strand within the stationary cradle of the double twist buncher.

The present invention concerns the method and apparatus of grouping a plurality of filaments each having its correct length by using a twisting flyer, setting the grouped filaments by using an over twist flyer and then completing the assembly of the balanced finished strand by using a standard double twist buncher. For purposes of this invention, a balanced strand is one in which each of the filaments of the strand has the correct length for its position in the strand thereby resulting in each filament taking its share of a load as it is applied to the strand.

The apparatus for making a balanced metallic strand includes a twisting flyer driven by a variable speed pulley wherein grouped filaments are wrapped approximately three-quarters of the way around freely revolving sheaves. The wire strands then pass through an over twist flyer and the grouped filaments are again wrapped approximately three-quarters of the way around the freely rotating sheaves. A common drive source provides the power source for both the variable speed drives as well as rotating the loop forming elements of the double twist buncher in synchronism. The double twist buncher includes a stationary cradle, capstan, a post-forming element or means, idler sheave and a traversing sheave. A take-up spool is mounted on the stationary cradle and conventional positive drive means is provided to the capstan and friction drive means of the spool.

DETAILED DESCRIPTION OF THE INVENTION

Figure 1:
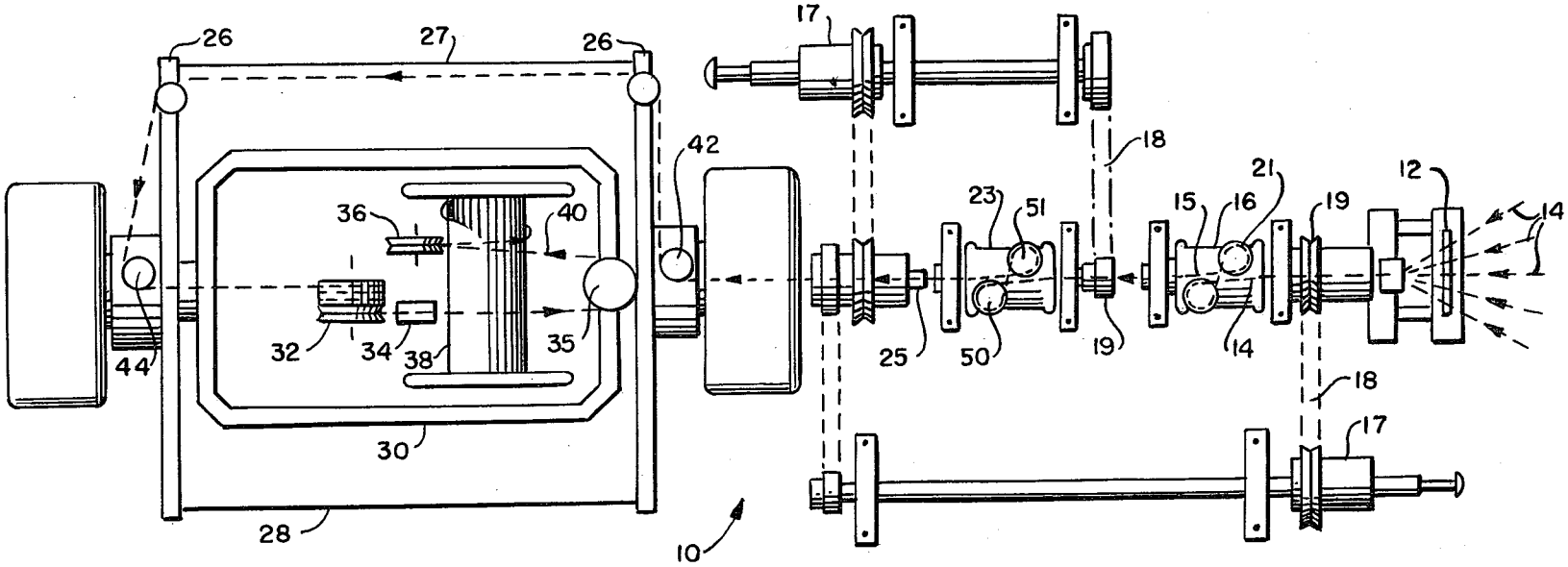
FIG. 1 is a plan view of the elements and the relationship to each other in accordance with the present invention.

Referring now to FIG. 1 of the drawings, the balanced strand making assembly or device 10 in accordance with the present invention includes a stationary guide element or means 12 to correctly align each of the plurality of metallic filaments 14 as they pass into the apparatus 10. Although not shown, filament let-off spools are provided and suitable guide pulleys arranged to feed the plurality of filaments 14 to the stationary guide means 12.

Figure 2:
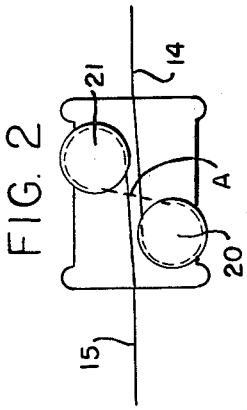
FIG. 2 is an enlarged plan view of the twisting flyer showing the path of travel of the grouped filaments around the sheaves in accordance with the present invention.

A twisting flyer 16 is positioned to receive the grouped filaments 14 and is driven by a variable speed pulley 17 and belt 18 driving pulley 19 which is affixed to the twisting flyer 16. The grouped filaments 14 are wrapped approximately three-quarters of the way around freely rotating sheave 20. The grouped filaments 14 then cross over and are wrapped approximately three-quarters of the way around freely rotating sheave 21. As shown in FIG. 2, the lay of the grouped filaments at point A is substantially that of the desired, finished balanced strand 40.

The strand 15 then is passed into an over twist flyer 23 positioned adjacent the twisting flyer 16. The over twist flyer 23 is similarly driven by a variable speed pulley 17 and a belt 18 driving pulley 19 which is affixed to the over twist flyer 23. The strand 15 is wrapped approximately three-quarters of the way around freely rotating sheave 50 and then is crossed over and wrapped approximately three-quarters of the way around freely rotating sheave 51. A common shaft 25 provides the power source for both variable speed drives as well as the drive (not shown) which rotates each end 26 of the loop forming element 27 of the double twist buncher mechanism 28 in synchronism.

The double twist buncher mechanism 28, schematically shown in FIG. 1, includes a stationary cradle 30, a capstan 32, a post-forming element or means 34, an idler sheave 35 and a transversing sheave 36. A take-up spool 38 is shown mounted in the stationary cradle 30. Conventional drive means to the capstan 32 and friction drive means to the take-up spool 38 are provided, but not shown. The postforming element or means 34 consists of a plurality of killer rollers and blocks for post forming the strand and sensing whether or not the strand contains cut or severed filaments.

In operating the strand making assembly 10, the end loop forming elements 26 are rotated at speed N, and 2N twists are imparted to the finished balanced strand 40. Also, depending upon the gearing to capstan 32, a given lay or pitch is provided in the balanced strand 40.

The twisting flyer 16 is rotated at substantially a speed of 2N. Accordingly, the lay or pitch of the grouped filaments at point A (FIG. 2) is substantially the same as that of finished balanced strand 40 and each filament has its correct length for its position in the grouped filament strand. For example, the core of a seven-wire strand must be shorter than the outer six-wire filaments. The over twisting flyer 23 is driven at a speed greater than 2N to sufficiently set the grouped filaments so that the finished balanced strand 40 will not fray when it is cut or severed.

The loop forming element 26 and the twisting flyer 16 and over twister flyer 23 all rotate in the same manner. The manner of all may be reversed so that both left- and right-hand lays or pitches can be produced in the finished strand 40, as desired.

In operation, when the strand 15 exits the over twister 23, the strand has sufficient length in the outer filaments to provide for a contraction at first twist roller 42 and enough length for further contraction of the outer filaments for the second twist roller 44. Thus, the lay or pitch of the grouped filaments at point A (FIG. 2), is substantially that of the finished balanced strand 40 and each filament has its correct length for its position in the grouped filaments.

From the foregoing description, it is also apparent that a balanced finished strand in high quality is provided economically using the combination of a twisting flyer and over twisting flyer and a double twist buncher, with the over twisting flyer positioned adjacent the twisting flyer and outside the double twist buncher. While there have been shown or described certain preferred embodiments of the invention it will be understood that various modification and rearrangements may be made therein without departing from the spirit and scope of the invention.

We claim:

1. A device for assembling a balanced finished strand from a plurality of filaments, including in combination:

double twist buncher means having a stationary cradle including haul-off and spooling means and further having means to revolve said strand in partially completed condition around said stationary cradle, a twisting flyer, and an over twist flyer positioned adjacent said twisting flyer outside of said stationary cradle, and wherein said double twist buncher means, said over twist flyer, and said twisting flyer are driven by a common source.

2. The device in accordance with claim 1 wherein said stationary cradle of said double twist buncher means further includes post forming means located between said haul-off and said spooling means.

3. The device in accordance with claim 1 further including stationary guide means which align each of said plurality of filaments prior to their grouping by said twisting flyer.

4. The device in accordance with claim 1 wherein the speeds of said over twist flyer and said twisting flyer are independently adjustable with respect to the speed of said double twist buncher means.

5. The method of forming a balanced finished strand from a plurality of filaments, including the steps of:

grouping a plurality of filaments each having its correct length by using a twisting flyer, setting the grouped filaments by using an over twist flyer, revolving the set grouped filaments around the stationary cradle of a double twist buncher means, and taking up and spooling said balanced strand within said stationary cradle of said double twist buncher means.

6. The method in accordance with claim 5 further including the step of post forming said strand after taking up but before spooling said strand.

7. The method in accordance with claim 5 wherein said balanced strand is composed of a plurality of filaments at least one of which is shorter in length than the outer of said filaments.

* * * * *